US005440814A

United States Patent [19]

Hall et al.

[11] Patent Number: 5,440,814

[45] Date of Patent: Aug. 15, 1995

[54] KNIFE WITH SIDE GUARDS

[75] Inventors: David K. Hall, Kodak; Kit Rae, Sevierville, both of Tenn.

[73] Assignee: United Cutlery Corporation, Sivierville, Tenn.

[21] Appl. No.: 201,767

[22] Filed: Feb. 25, 1994

[51] Int. Cl.[6] ..... B26B 29/02

[52] U.S. Cl. ..... 30/295; 30/286

[58] Field of Search ..... 30/286, 295, 296.1, 30/298, 284, 285, 290, 291; 294/131

[56] References Cited

U.S. PATENT DOCUMENTS 1,574,641 2/1926 Christopherson ..... 30/286

FOREIGN PATENT DOCUMENTS 1196545 6/1970 United Kingdom ..... 30/295

*Primary Examiner*—Hwei Siu Payer

*Attorney, Agent, or Firm*—Lalos & Keegan

[57] ABSTRACT

A knife comprising a handle, a blade mounted on the handle, a pair of side guards mounted on the handle and movable between an open position and a closed position. The pair of side guards enclose at least a portion of the blade when in the closed position. An actuating mechanism is provided for actuating the pair of guards between the open position and the closed position. The actuating mechanisms includes a button movable between a forward position and a rear position and operable with the pair of side guards such that when the button is in the forward position, the pair of side guards is moved to the open position and when the button is in the rear position, the pair of side guards is moved to the closed position. Preferably, the button includes two protrusions at the lower surface thereof which interact with receptacles formed by a notch in each side guard and the edges of the side guards such that when the button is moved within the slot, the side guards are cammed between the open and closed positions. Also provided is a steel spring for biasing against the side guards.

19 Claims, 3 Drawing Sheets

KNIFE WITH SIDE GUARDS

BACKGROUND OF THE INVENTION

The invention relates to an improved knife, and more particularly, to an improved knife including a pair of side guards movable between a closed position to an open position and the mechanism for actuating the same.

The most relevant prior art known to the inventor is U.S. Pat. No. 718,150 to Perry, entitled "Bayonet." Disclosed in this reference is a bayonet to be attached to a firearm and including a pair of hand guards which are movable between an open and closed position. A spring is used to bias the hand guards in the open position. The hand guards are secured in the closed position by a bolt received within a notch formed in the hand guards.

SUMMARY OF THE INVENTION

The present invention includes a knife comprising a handle, a blade mounted on the handle and a pair of side guards also mounted on the handle and movable between an open position and a closed position. The pair of side guards encloses at least a portion of the blade when in the closed position. An actuating mechanism is provided for actuating the pair of guards between the open position and the closed position. The actuating mechanisms includes a button movable between a forward position and a rear position and operable with the pair of side guards such that when the button is moved to the forward position, the pair of side guards is moved to the open position and when the button is moved to the rear position, the pair of side guards is moved to the closed position. Preferably, the button includes two protrusions at the lower surface thereof which interact with receptacles formed by a notch in each side guard and the edges of the side guards such that when the button is moved within the slot, the side guards are cammed between the open and closed positions. A steel spring is provided to bias the side guards in the closed and open positions.

DESCRIPTION OF THE PREFERRED EMBODIMENTS

Figure 1:
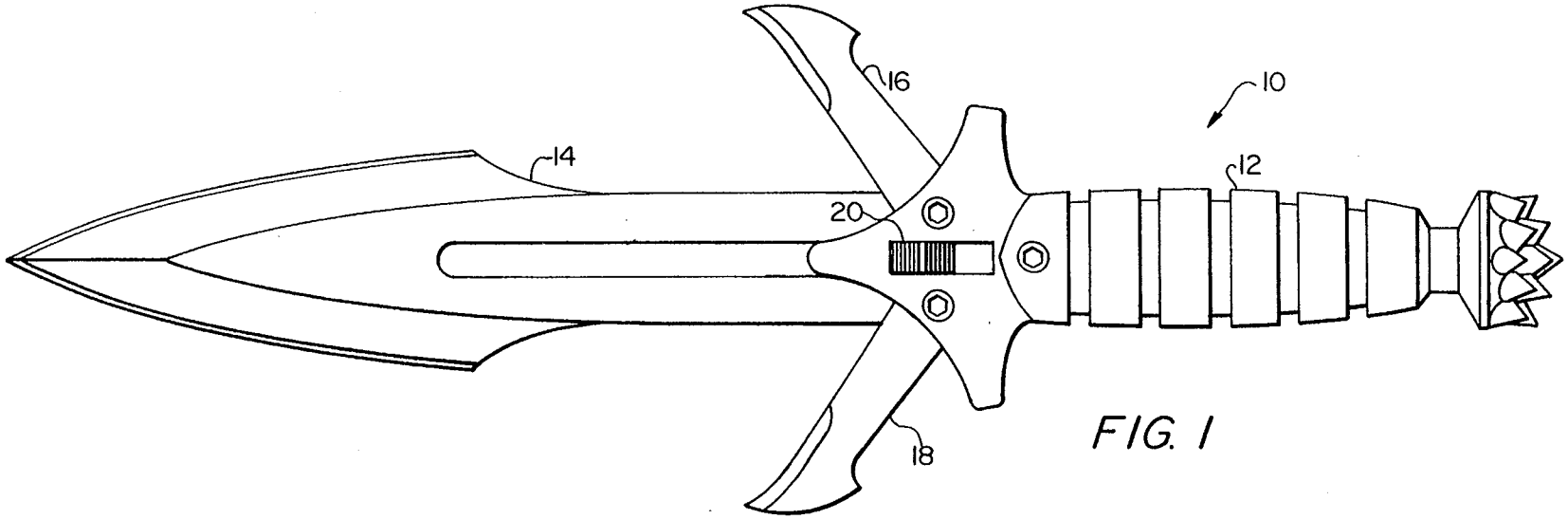
FIG. 1 is a plan view of the preferred embodiment of the present invention with the guards in the open position.
Figure 2:
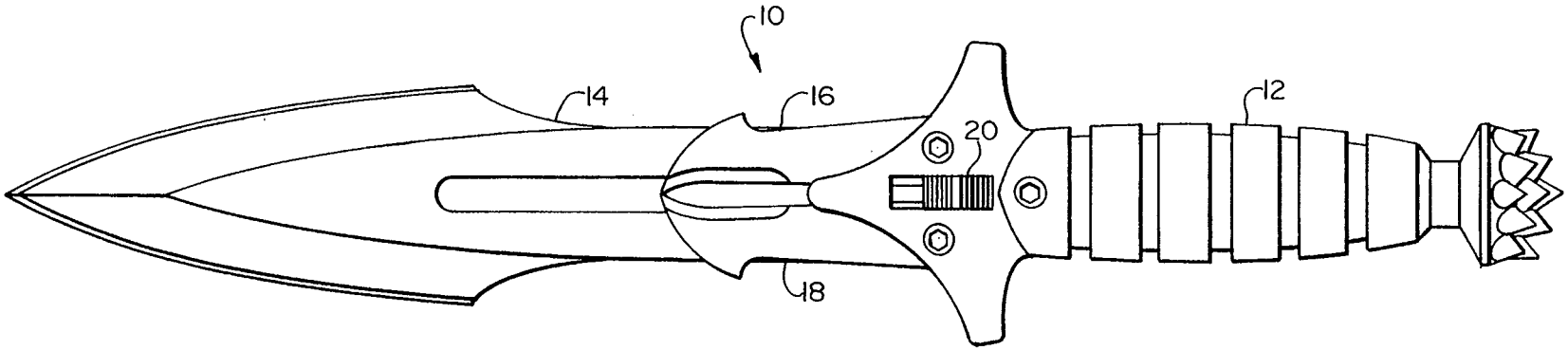
FIG. 2 is a plan view of the embodiment of FIG. 1 with the guards in the closed position.

Referring to the illustration of the present invention shown in FIGS. 1–6, the knife, shown generally as 10, includes a handle 12, a blade 14, a right side guard 16, a left side guard 18 and an actuating button 20. As seen in FIGS. 1 and 2, the right and left side guards 16 and 18 are movable between an open position (FIG. 1) and a closed position (FIG. 2) as button 20 moves between a forward position and a rearward position.

Figure 3:
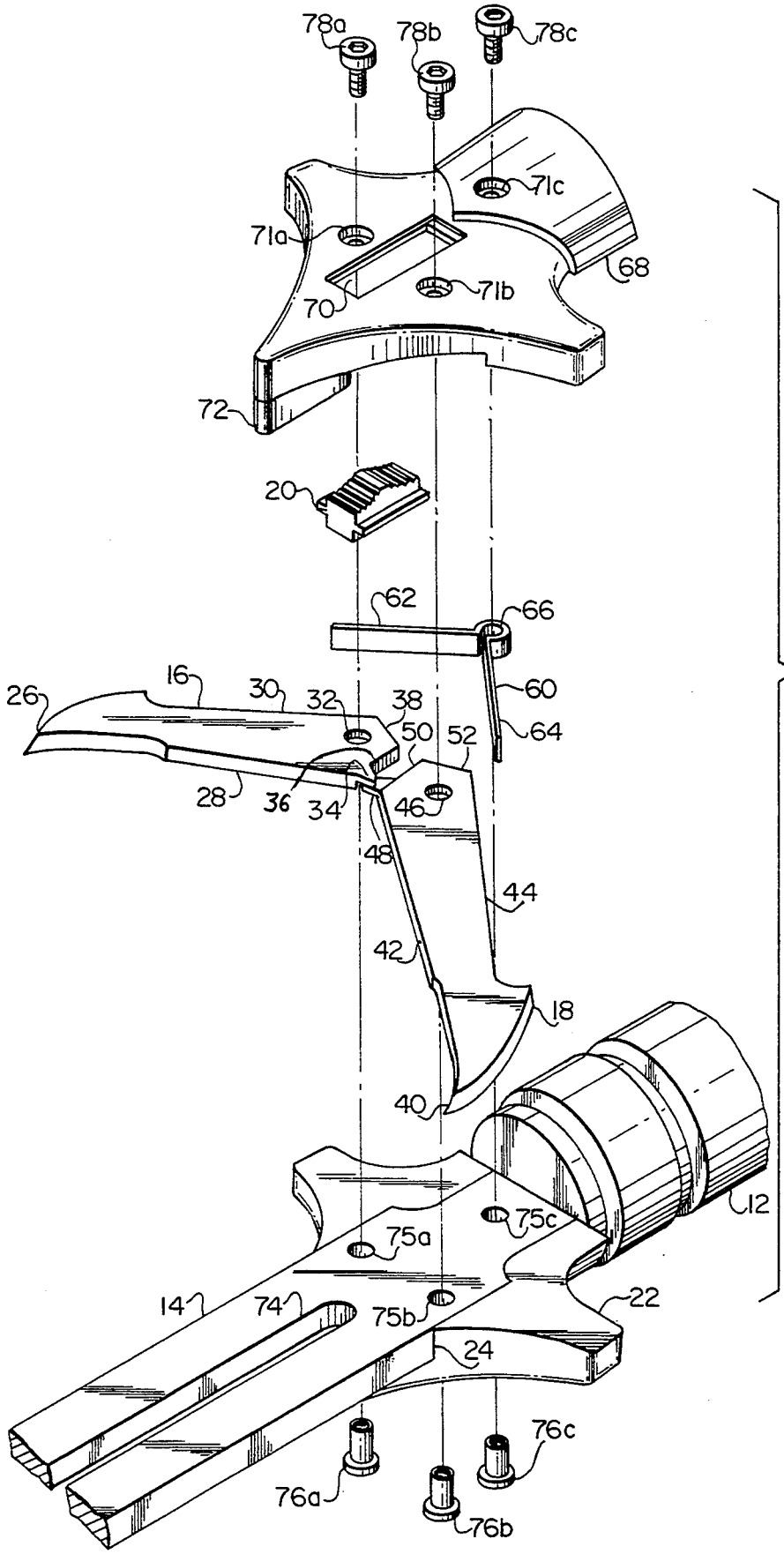
FIG. 3 is an exploded perspective view of the embodiment shown in FIGS. 1 and 2.

As best seen in FIG. 3, handle 12 includes a support 22 on which blade 14 and side guards 16, 18 are mounted. Preferably, support 22 includes an indentation 24 in which a portion of blade 14 is received. Additionally, to provide better support for the blade, a second cavity (not shown) may be provided in the handle into which an extension of blade 14 may be received.

Right and left side guards 16, 18 are mirror images of one another. Right side guard 16 includes a pointed tip 26, an inside edge 28, an outside edge 30 and a pivot hole 32. Disposed at the rear portion of inside edge 28 is a notch 34. Right side guard 16 also includes a first flattened surface 36 disposed at an acute angle relative to inside edge 28 and a second flattened surface 38 disposed at an acute angle relative to outside edge 30. Similarly, left side guard 18 includes a pointed tip 40, an inside edge 42, an outside edge 44, a pivot hole 46, a notch 48, a first flattened surface 50 disposed at an acute angle relative to inside edge 42 and a second flattened surface 52 disposed at an acute angle relative to outside edge 44.

Figure 6:
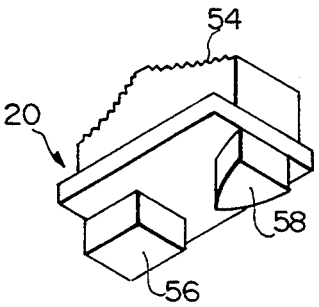
FIG. 6 is a detail view of an element of the embodiment shown in FIGS. 1–5.

Button 20, shown in detail in FIG. 6, includes an upper surface 54 and two lower protrusions 56 and 58. Upper surface 54 is preferably knurled to facilitate gripping of the surface. In a preferred embodiment, protrusion 56 is generally square in shape, while protrusion 58 is generally triangular in shape.

Again referring to FIG. 3, a spring 60 is provided with wings 62 and 64 and a hole 66. When side guards 16, 18 are in the closed position, as shown in FIG. 5, wing 62 rests against flattened surface 38, while wing 64 rests against flattened surface 52. When side guards 16, 18 are in the open position, as shown in FIG. 4, wing 62 rests against outside edge 30 and wing 64 rests against outside edge 44.

A cover member 68 is provided to retain the component members of the actuating assembly in place against handle 12. As seen in FIG. 3, cover member 68 includes a rectangular slot 70 within which button 20 is received and three holes **71*a*, 71*b* and 71*c* for receiving mounting hardware, as hereinafter described. On the forward portion of cover member 68 is a downwardly disposed projection 72 which, when assembled, is received within a slot 74 of blade 14**.

The components of the actuating assembly are secured by means of three internally threaded studs **76*a*, 76*b*, 76*c* and three screws 78*a*, 78*b* and 78*c*. One stud/screw combination 76*a*, 78*a* extends through hole 71*a* of cover member 68, pivot hole 32 of right side guard 16, a hole 75*a* in blade 14 and support 22 of handle 12. A second stud/screw combination 76*b*, 78*b* extends through hole 71*b* of cover member 68, pivot hole 46 of left side guard 18, a hole 75*b* in blade 14 and support 22. The third stud/screw combination 76*c*, 78*c* extends through hole 71*c* of cover member 68, hole 66 of spring 60, a hole 75*c* of blade 14 and support 22**.

Figure 4:
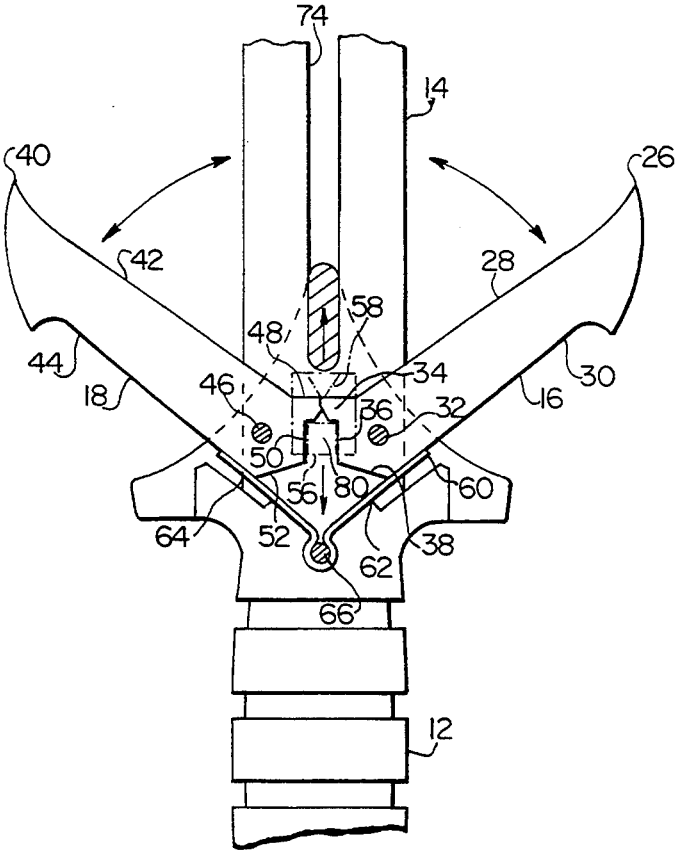
FIG. 4 is a partial cross-sectional view of the embodiment shown in FIGS. 1–3 with the guards in the open position.
Figure 5:
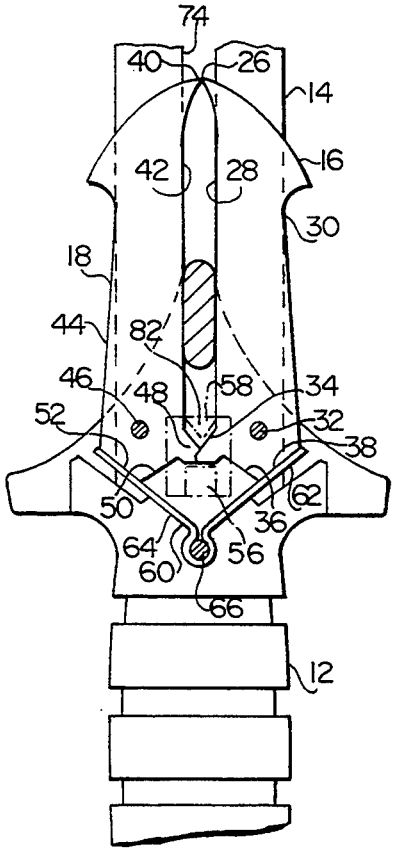
FIG. 5 is a partial cross-sectional view of the embodiment shown in FIGS. 1–4 with the guards in the closed position.

The operation of the actuating assembly will be described with reference to FIGS. 4 and 5, shown with cover member 68 omitted for clarity. When side guards 16, 18 are in the open position, shown in FIG. 4, button 20 is in the forward position. The wings 62, 64 of spring 60 rest against outside edges 30, 44 of the right and left side guards, respectively. Notches 34, 48 together with right side guard flattened surface 36 and left side guard flattened surface 50 form a receptacle 80. Receptacle 80 is generally square in shape and is adapted to receive protrusion 56 of button 20 therein.

As button 20 is moved to the rearward position, side guards 16, 18 pivot about pivot holes 32, 46, respectively, as notches 34, 48 are caused to be cammed between square protrusion 56 and triangular protrusion 58. Once the button is in the rear position, side guards 16, 18 are closed and the wings 62, 64 of spring 60 rest against flattened surface is 38, 52, respectively. A second receptacle 82 is now formed between notches 34, 48, inside edge 28 of right side guard 16 and inside edge 42 of left side guard 18. Receptacle 82 is generally triangular in shape and is adapted to receive protrusion 58 therein. It can thus be seen that the interaction between button 20, receptacles 80 and 82 and notches 34, 48 enable side guard 16, 18 to be actuated between the open and closed positions.

The wings 62, 64 of spring 60 are biased inwardly so that as side guards 16, 18 are moved between the open and closed positions, the side guards force the spring outwardly, against its bias. In this way, the spring 60 aids in retaining the side guards in both the open and closed positions.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

I claim:

1. A knife comprising:

a handle;

a blade mounted on the handle;

a pair of side guards mounted on the handle and movable between an open position and a closed position, the pair of side guards enclosing at least a portion of the blade when in the closed position; and means for simultaneously actuating the pair of guards between the open position and the closed position, the actuating means comprising a button movable between a forward position and a rear position and operable with the pair of side guards such that when the button is moved to the forward position, the pair of side guards is moved to the open position and when the button is moved to the rear position, the pair of side guards is moved to the closed position.

2. A knife according to claim 1, wherein the handle includes a support on which the blade and side guards are mounted.

3. A knife according to claim 1, wherein the handle includes an indentation at the forward end thereof in which a portion of the blade is received.

4. A knife according to claim 1, wherein each of the pair of side guards includes an inside edge and a notch at a rear portion of the inside edge.

5. A knife according to claim 4, wherein the button includes a forward protrusion and a rear protrusion.

6. A knife according to claim 5, wherein the first forward protrusion is received within the forward receptacle and the rear protrusion is received within the rear receptacle and the protrusions interact with the notches so that when the button is moved between the forward and rear positions, the side guards are cammed between the open and closed positions.

7. A knife according to claim 4, wherein the notches and the inside edges of the pair of side guards form a forward receptacle when the pair of side guards is in the closed position, and wherein the notches and the rear surfaces of the pair of side guards form a rear receptacle when the pair of side guards is in the open position.

8. A knife according to claim 7, wherein the forward receptacle is generally triangular in shape.

9. A knife according to claim 8, wherein the button includes a generally triangular forward protrusion received within the forward receptacle when the button is in the position.

10. A knife according to claim 9, wherein the rear receptacle is generally square in shape and the button includes a generally square rear protrusion received within the rear receptacle when the button is in the position.

11. A knife according to claim 10, wherein the protrusions interact with the notches so that when the button is moved between the forward and rear positions, the side guards are cammed between the open and closed positions.

12. A knife according to claim 7, wherein the rear receptacle is generally square in shape.

13. A knife according to claim 12, wherein the button includes a generally square rear protrusion received within the rear receptacle when the button is in the position.

14. A knife according to claim 7, wherein each of the pair of side guards includes at least one flattened surface at the rear surface thereof.

15. A knife according to claim 7, wherein each of the pair of side guards includes a first, inside flattened surface and a second, outside flattened surface at the rear surface thereof, each of the first and second flattened surfaces being disposed at an angle relative to one another.

16. A knife according to claim 15, wherein the rear receptacle is formed by the notches and the first inside flattened surfaces.

17. A knife according to claim 15, further comprising a spring including two wings for biasing the side guards in both the open position and the closed position, wherein at least one wing cooperates with one of the first and second flattened surfaces.

18. A knife according to claim 17, wherein the wings of the spring contact the outside edges of the pair of side guards when the pair of side guards are in the open position and the second flattened surfaces when the pair of side guards are in the closed position.

19. A knife according to claim 1, wherein each of the pair of side guards includes a hole through which a pivot pin is received and about which the side guard pivots when moving between the open and closed positions.

* * * * *

UNITED STATES PATENT AND TRADEMARK OFFICE

CERTIFICATE OF CORRECTION

PATENT NO. : 5,440,814

DATED : August 15, 1995

INVENTOR(S) : David K. Hall

It is certified that error appears in the above-identified patent and that said Letters Patent is hereby corrected as shown below:

In Column 4:

Claim 6, line 1, delete "first".

Claim 7, line 4, delete "the" preceding "rear surfaces".

Claim 9, line 4, add -- rear -- before "position".

Claim 10, line 5, add -- forward -- before "position".

Claim 13, line 4, add -- forward -- before "position".

Signed and Sealed this

Twenty-first Day of November, 1995

Bruce Lehman

*Attest:*

BRUCE LEHMAN

*Attesting Officer*

*Commissioner of Patents and Trademarks*